US010907446B2

(12) United States Patent
Khachaturov

(10) Patent No.: US 10,907,446 B2
(45) Date of Patent: Feb. 2, 2021

(54) TELEMETRY SYSTEM AND METHOD FOR COOLING DOWNHOLE ELECTRONICS

(71) Applicant: Dmytro Khachaturov, Kharkov (UA)

(72) Inventor: Dmytro Khachaturov, Kharkov (UA)

( * ) Notice: Subject to any disclaimer, the term of this patent is extended or adjusted under 35 U.S.C. 154(b) by 97 days.

(21) Appl. No.: 16/360,518

(22) Filed: Mar. 21, 2019

(65) Prior Publication Data

US 2020/0300060 A1 Sep. 24, 2020

(51) Int. Cl.
*E21B 36/00* (2006.01)
*F25B 21/04* (2006.01)
*E21B 47/13* (2012.01)

(52) U.S. Cl.
CPC ..... *E21B 36/001* (2013.01); *E21B 47/13* (2020.05); *F25B 21/04* (2013.01)

(58) Field of Classification Search
CPC .. E21B 36/001; E21B 41/0085; E21B 47/017; E21B 47/0175
See application file for complete search history.

(56) References Cited

U.S. PATENT DOCUMENTS 7,527,101 B2 * 5/2009 Mayes ..... H01L 35/00 166/302
2005/0211436 A1 * 9/2005 Fripp ..... E21B 41/0085 166/302
2006/0162931 A1 * 7/2006 Mayes ..... E21B 47/017 166/302
2010/0024436 A1 * 2/2010 DiFoggio ..... E21B 47/017 62/3.2
2013/0026978 A1 * 1/2013 Cooley ..... H01M 10/0568 320/107
2013/0061899 A1 * 3/2013 Tosi ..... E21B 41/0085 136/202
2015/0107824 A1 * 4/2015 Signorelli ..... E21B 41/0085 166/244.1
2016/0273309 A1 * 9/2016 Maher ..... E21B 47/017
2019/0368314 A1 * 12/2019 Tackmann ..... E21B 47/07

* cited by examiner

*Primary Examiner* — Shane Bomar

(57) ABSTRACT

The present invention provides a system for monitoring wells and a method for powering the means used to cool heat-generating devices.

A telemetry system includes surface and downhole units and an alternating voltage source. A low pass filter is installed in the surface unit. A switching device is installed in the surface unit and configured to change the polarity of the voltage. A transformer is installed in the downhole unit, through the primary winding of which low-pass filtering is performed, and the secondary winding sets an independent phase. Thermoelectric coolers are installed in the downhole unit. The thermoelectric coolers receive power from the source of alternating voltage through a neutral of a set-up transformer and a radial motor and the independent phase of the transformer of the downhole unit.

12 Claims, 6 Drawing Sheets

TELEMETRY SYSTEM AND METHOD FOR COOLING DOWNHOLE ELECTRONICS

CROSS-REFERENCE TO RELATED APPLICATIONS

Not Applicable.

BACKGROUND OF THE INVENTION

The present disclosure generally relates to well operation tools and in particular, to a system for monitoring wells and methods for powering the means used to cool heat-generating devices.

Quite frequently, the causes of failure of measuring devices are due to the reduced insulation on the data and electrical energy line, the effect of interference, the failure of connecting elements, high temperature in the well, and various uncommon designs of such devices. These factors affect reliability of the equipment.

In this area, there are several directions for the improvement of surface and downhole units of these devices, which ensure reliable utilization and obtaining reliable parameters of wells for controlling the operation of pumps.

The patent RU2230187 to Zakharchuk et al. (2004) solves the problem of improving accuracy and reliability of signal transmission. However, the possibility of checking the insulation condition of the device has not been implemented and protecting the surface unit against high-voltage interference that is specific for utilization of such equipment is not specified.

Distinctive designs are well-known, such as devices that imply placement of measurement devices around the shaft GB2502880 to Fonneland (2013); RU2538013 to Glavatskyh et al. (2015). However, these technical solutions are characterized by limited protective elements in the submersible device, aimed directly to ensure the fault-free utilization of the downhole unit in the conditions of voltage and pressure drops.

To increase the information value of the measurement results and/or the reliability of the devices, several downhole units with sensors can be used. Such units duplicate and/or complement each other. U.S. patent Ser. No. 11/164,428 to Jamieson et al. (2007) presents the serial connection of sensors that can lead to the failure of the entire system in case of damage or depressurization of a single unit. Also, such solutions require sealing of cable connections. The invention RU180608 to Glavatskyh et al. (2018) assumes the existence of a large number of links between several telemetry modules, which reduces the reliability of the device. In the application US2014055277A1 elements for protection of the system against high voltage in the normal mode are not described and they are also not described for the mode of failure of one of the telemetries, which reduces the reliability of the system.

In addition, to ensure the reliability of the submersible measuring equipment in high temperature, thermoelectric cooling systems are applied. The application EP2740889A1 (2014) proposes the usage of inert gas that does not provide sufficiently uniform cooling of electronic components. In the patent U.S. Pat. No. 7,527,101 to Mayes (2009), the method assumes the presence of an additional downhole energy source, the turbine generator for converting hydraulic energy of the drilling fluid, which causes an increase in the probability of failure and limited scope of implementation, which is associated with the need for a drilling fluid and is not sufficiently applicable under well operation conditions.

In the patent RU133197 to Antimyrov et al. (2010), the method assumes the transfer of energy through the general line for the electronic parts and the Peltier elements, which requires additional energy input.

The operation of a thermoelectric system implies consumption of a relatively big amount of energy. In the conditions of the need to comply with technical requirements, it may serve as a reason for reducing the efficiency of the system in cases of insufficient voltage transmitted from the surface equipment to the downhole measuring equipment and to its cooling system.

Thus, increasing the reliability of downhole measurement devices and the reliability of the results of measurements in various areas require an improvement.

SUMMARY OF THE INVENTION

The present invention provides a system for monitoring wells and a method for powering the means used to cool heat-generating devices.

A telemetry system comprises a surface unit, a downhole unit and an alternative voltage source in connection through independent phase with the downhole unit.

The surface unit comprises a low-pass filter on the input of the surface unit to protect the telemetry system against overly high voltage. Also, the surface unit comprises a switch in connection with a voltage resistor configured to change the polarity of the voltage.

The downhole unit comprises a transformer, the primary winding of which includes low-pass filter configuration and the secondary winding sets an independent phase. Thermoelectric coolers are in connection through this independent phase with the alternating voltage source. The invention ensures the transmission of electricity to the thermoelectric coolers through the additional source.

The thermoelectric coolers cool electronic components, which are grouped in several groups depending on the maximum temperature limits of their utilization, so that the spread of the average of maximum temperature limits of their operation in each group is minimal. Cooled elements before installing the thermoelectric coolers may be placed on a viscous heat-conducting composition to create conditions for uniform cooling.

The downhole unit may be associated with a shaft or rotor bearings. This design can be implemented on the basis of the electrical circuit of the submersible and surface units. In this embodiment, the use of a pre-compressed inner and pre-stretched outer tubes ensures a uniform distribution of the resilient perception of pressure drops by the downhole unit associated with a shaft or rotor bearings. The use of spacers in the radial direction provides additional protection against the deformation of electronics.

According to another embodiment, the system further comprises at least one additional downhole unit connected with the downhole unit through an additional transmission line of data and energy. The additional downhole unit includes any of the well-known telemetries or multiple sensors or one sensor which performs from the minimal value of electricity that can be transmitted from the surface unit through the downhole unit. This embodiment provides an extension of the measurement zone. The downhole unit can collect and convert measurement parameters from the additional downhole unit. For convenience of mounting the downhole unit, the telemetry system may include a set of interchangeable threaded elements. The downhole unit and additional downhole unit may include sealed cable entries for installation of a conductive core and a set of deformable sealing elements configured with the possibility of radial and end sealing of the conductive core of the transmission line of data and energy under the pressure of a fluid.

The telemetry system may include a double downhole unit which duplicates its functions, both parts of which have identical design and do not communicate with each other.

In this embodiment the surface unit includes additional switches and resistors in connection through the transmission line of data and energy with the parts of the downhole unit to maintain voltage control of the downhole unit and to provide energy efficiency.

The invention increases the reliability of the telemetry system and the reliability of the results of the measurements.

BRIEF DESCRIPTION OF THE DRAWINGS

For a more detailed description of the embodiments, references will now be made to the following accompanying drawings.

DETAILED DESCRIPTION OF THE EMBODIMENTS

Several specific embodiments of the present disclosure will be provided below. These embodiments are only examples of the presently disclosed techniques.

Beyond that, aiming to provide a brief description of these embodiments, all features of an actual implementation may not be covered in the specification. It should be appreciated that over the course of the development of any actual implementation, as in any engineering or design project, a variety of implementation-specific decisions must be taken to achieve the developer's specific objectives, such as compliance with system-related and business-related constraints, which may vary depending on specific aspects of an implementation. Moreover, it should be taken into account that such a development effort might be complex and time consuming, but would nevertheless be a routine undertaking of design, fabrication, and manufacture for those of ordinary skill having the benefit of this disclosure. The drawings and the description below disclose specific embodiments with the idea that the embodiments are to be viewed as an exemplification of the principles of the disclosure and do not aim to limit the disclosure to the one illustrated and described.

Figure 1:
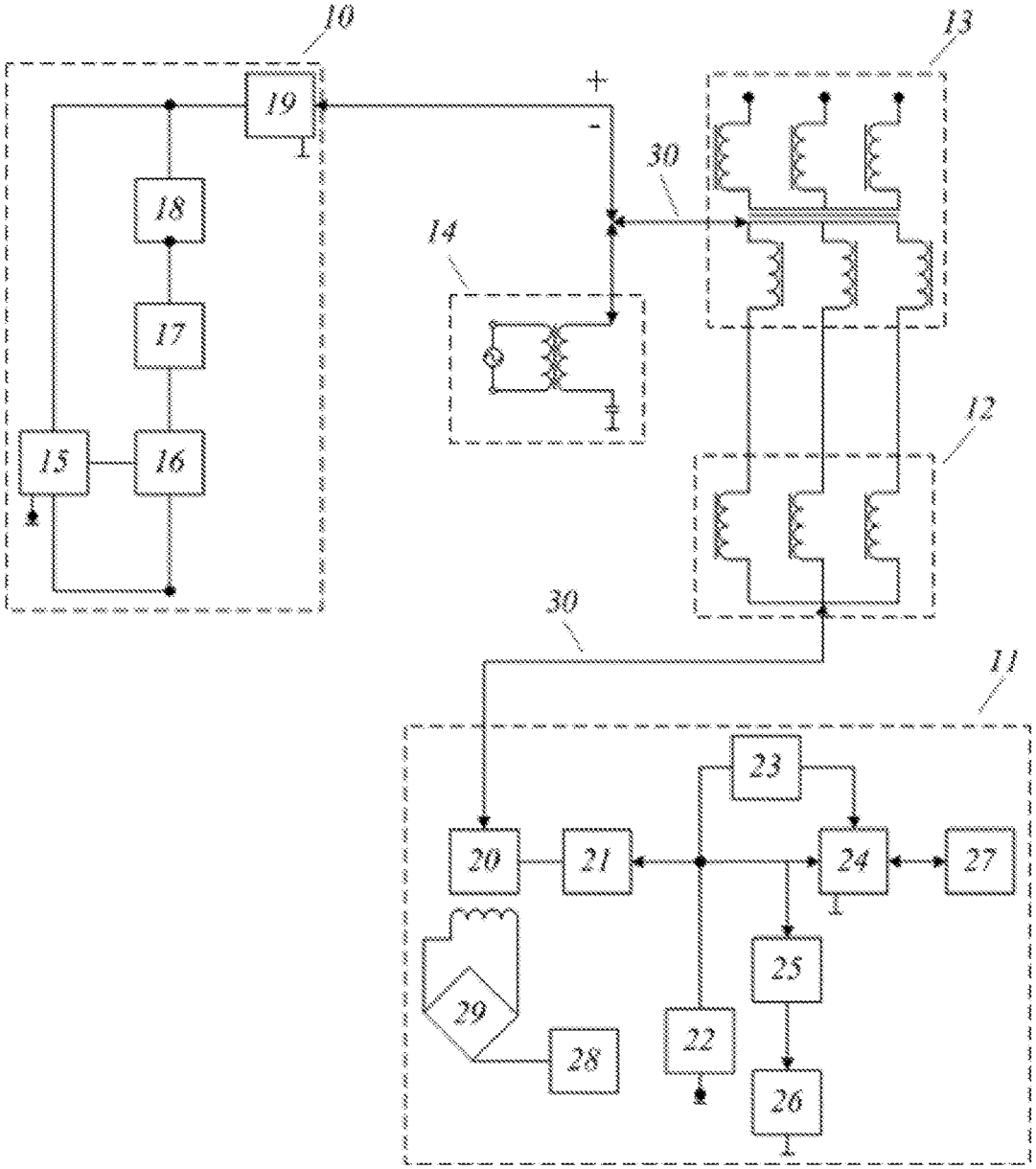
FIG. 1 illustrates the electrical circuit of a telemetry system.
Figure 2:
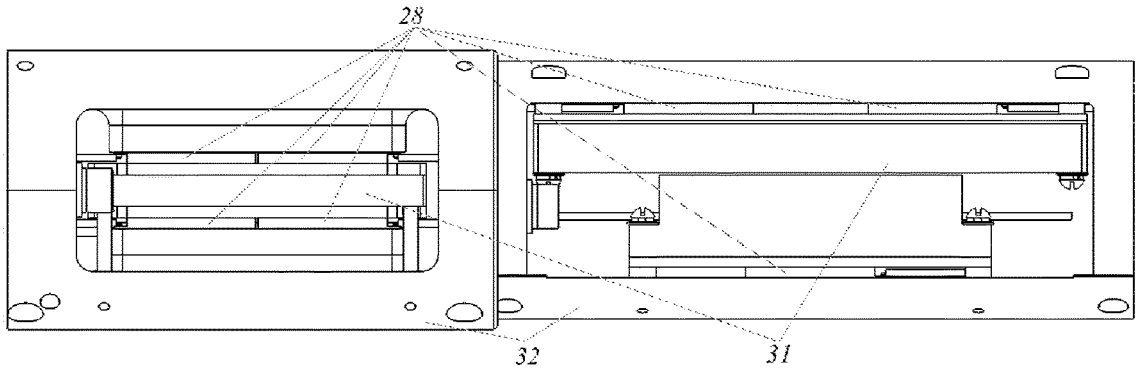
FIG. 2 illustrates a placement of thermoelectric coolers in a downhole unit of a telemetry system.

FIGS. 1 and 2 illustrate the first embodiment of a telemetry system. The telemetry system includes surface unit 10, downhole unit 11 and alternating voltage source 14.

In surface unit 10, direct voltage source 15 and universal microprocessor controller 16 are installed and connected with downhole unit 11 through transmission line of data and energy 30. The direct voltage source 15 powers the downhole unit 11.

Low-pass filter 19 is installed on the input of the surface unit 10. Filter 19 is configured to protect the device against overly high voltage.

To measure the insulation resistance in surface unit 10, an analog-to-digital converter (not shown in FIGS.) is installed between universal microprocessor controller 16 and low-pass filter 19 of surface unit 10. The voltage is measured on transmission line of data and energy 30 by the analog-digital converter. A switching device is installed in surface unit 10. It includes switch 17 which is configured to change the polarity of the voltage supplied to line 30. Switch 17 is connected to resistor 18 for the removal of voltage.

Measurement and transmission device 24 is installed in downhole unit 11. Measurement and transmission device 24 includes electronic components with plurality of sensors 27. Measurement and transmission device 24 is configured to receive data from any well-known well parameter sensors or a set of sensors combined into a separately device. Voltage regulator 22 is connected in parallel with measurement and transmission device 24. Output signal generator 25 and data switch 26 are connected in series with measurement and transmission device 24. Data switch 26 is controlled by measurement and transmission device 24. Measurement and transmission device 24, voltage regulator 22 and switch 26 are connected to an earth enclosure.

Downhole unit 11 includes a filtering and protection device which includes transformer 20 and protection node 21 which are connected in series. In downhole unit 11, low-pass filtering is performed through the primary winding of transformer 20 and an independent phase is set by the secondary winding.

Excessive voltage is filtered by the primary winding and transmitted through the secondary winding to the thermoelectric coolers.

Downhole unit 11 includes voltage filter 23, which identifies a useful signal under the influence of interference on line 30 for universal microprocessor controller 16 which is installed in surface unit 10.

In downhole unit 11, thermoelectric coolers 28 are installed on electronic components. For example, elements based on the Peltier effect may be used as thermoelectric coolers 28. Thermoelectric coolers 28 are connected with alternating voltage source 14 by the above-mentioned independent phase of transformer 20 of downhole unit 11 through rectifier 29, radial motor 12 and neutral of step-up transformer 13 of the transmission line of data and energy 30.

Electronics of the downhole unit are grouped in downhole unit 11 into several groups depending on the maximum temperature limits of their utilization, so that the spread of the average of maximum temperature limits of their operation in each group is minimal. This arrangement of electronic components causes the most rational installation and use of thermoelectric coolers 28. Material of printed circuit boards for electronic components can be chosen from any material that is characterized by high thermal conductivity, for instance, aluminum. Thus, thermoelectric coolers 28 will cool the electronics groups well through these printed circuit boards. As shown in the example in FIG. 2, two groups 31 (left and right parts) of electronic components can be cooled in this way by various amount of thermoelectric coolers 28. In addition, the distance between thermoelectric coolers 28 can be varied to achieve sufficient cooling. The distance between thermoelectric coolers 28 is filled with a substance containing appropriate thermal conductivity; for example, inert gas or airgel, on behalf of creation conditions for maximum cooling of electronic components of downhole unit 11 of the telemetry system.

A method for cooling downhole electronics of the telemetry system includes the operation of cooling a variety of electronic components of downhole unit 11 by thermoelectric coolers 28. Heat is transferred to the body of cooled elements after which heat is transferred to pipe 32 into which downhole unit 11 is placed. Pipe 32 is cooled with a fluid.

The performance of thermoelectric coolers 28 is selected in accordance with the groups of electronics in downhole unit 11 so that the group of electronic components with a higher average of their maximum temperature limits is cooled by thermoelectric coolers which perform in total more heat transfer than the thermoelectric coolers which are installed on electronic components with a lower average of their maximum temperature limits. Depending on the embodiments of the invention, it is possible to vary the number and connection scheme of the thermoelectric coolers to achieve required performance.

The power supply is transmitted to thermoelectric coolers 28 from alternating voltage source 14 through the independent phase of transformer 20 of downhole unit 11, rectifier 29 of downhole unit 11, radial motor 12 and neutral of step-up transformer 13 of transmission line of data and energy 30.

Thus, on the basis of the system which is characterized by jamming resistance, the implemented method ensures the transmission of electricity to thermoelectric coolers through the additional source. This provides growth of the service life under operating temperature conditions and increase of the efficiency of thermoelectric coolers in higher temperatures through ensuring the operation of the telemetry system. It increases reliability and ensures uniform technical requirements for energy consumption. The empirical data obtained as a result of the test of the invention shows the possibility of using the telemetry system in conditions with a temperature 30° C. higher in comparison with similar systems without similar novelty due to the additional power supply source for thermoelectric coolers.

Needlessness of such devices as, for example, various energy generators, when implementing the method allows for one to utilize the equipment in a more cost-effective way, to increase the reliability of the telemetry system and to increase its application areas and its energy efficiency.

Cooled elements before installing thermoelectric coolers 28 may be placed on a viscous heat-conducting composition to create conditions for uniform cooling. The volume of viscous heat-conducting composition to be filled on electronic components corresponds to the characteristics of thermal expansion of this composition. This solution protects the electronics of the downhole unit from depressurization in case of excessive expansion of the composition.

As an example, a sealing compound consisting of heat-resistant elastic compounds obtained on the basis of low-molecular-weight dimethylsiloxane rubber was used. The experiment showed that the thermal expansion of this sealant did not exceed 12% until reaching the ambient temperature of 175° C. That is, when operating the system with the sealing compound mentioned above in conditions with a temperature not exceeding 175° C., it is necessary to fill 88% of the space in which cooled elements are placed.

The installation of cooled elements in a viscous composition provides the uniformity of heat transfer processes in the system.

Figure 3:
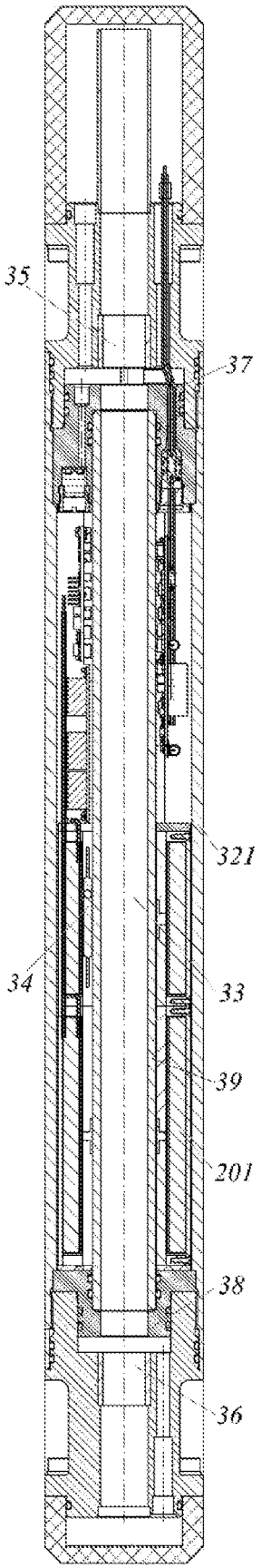
FIG. 3 illustrates an exemplary of a telemetry system associated with a shaft or rotor bearing.

As shown in FIG. 3 the downhole unit may be associated with shaft 33 or rotor bearings. This design with the possibility of modifications can be implemented on the basis of the electrical circuit of surface units 10 and downhole 11, which are shown in FIG. 1 using a motor that includes a shaft. The connection with shaft 33 in this case is carried out through bearings 35, 36. Electronics of downhole unit 11 are located between pre-compressed inner 39 and pre-stretched outer 321 tubes in the radial direction and between at least two spacers 37, 38 in the axial direction.

The use of pre-compressed inner 39 and pre-stretched outer 321 tubes ensures a uniform distribution of the perception of pressure drops by the downhole unit 11 associated with a shaft or rotor bearings. The use of spacers 37, 38 in the radial direction provides additional protection against deformation of electronics.

The telemetry system may additionally include switching device 34 of downhole unit 11 mounted on the inner radius of the filtering part of transformer 201. For instance, a reed switch may be used as the switching device. The use of the switching device provides the design of the downhole unit associated with a shaft or rotor bearings with enhanced functionality.

Tests have shown that the invention provides operability at a reservoir temperature of up to 175° C., a root mean square vibration of up to 30 $m/s^2$, and a hydrostatic pressure in a suspension zone of downhole unit 11 of up to 400 atmospheres.

As shown in FIGS. 4 A-D, the telemetry system may include at least one additional downhole unit 41 connected with downhole unit 11 through an additional transmission line of data and energy. In this case, additional downhole unit 41 is powered through additional line 42 and unit 11 from surface unit 10. Additional downhole unit 41 is placed above pump 40 and motor 12 of a submersible device. Downhole unit 11 is installed on the bottom of radial motor 12. This embodiment provides an extension of the measurement zone.

Downhole unit 11 can collect and convert measurement parameters from additional downhole unit 41. Additional downhole unit 41 can be any of the well-known telemetries or multiple sensors, or one sensor which consumes the minimal value of energy that can be transmitted from surface unit 10 through downhole unit 11. Unit 11 is configured to collect, convert and transmit measurement parameters.

For convenience of mounting units 11 and 41, the telemetry system may include a set of interchangeable threaded elements 44, 45, 451, 452. Threaded provisional liners 45, 451, 452 are mounted on end adapters 48, 482 sealed on the ends of downhole units 11, 41. The ends of units 11, 41 are equipped with sealed cable entries 491 and 492 for installation of conductive core 51 and with set of deformable sealing elements 54, 55. Conductive core 51 of transmission line of data and energy is placed in housing 52 with collet sleeve 53. Set of deformable sealing elements 54, 55 is configured with the possibility of radial and end sealing of conductive core 51. Sealing elements 54, 55 ensure complete tightness of cable core 51 under the pressure of a fluid. For example, polymeric materials may be used as sealing elements.

Interchangeable threaded elements 44, 45, 451, 452 are made in the form of removable collets 44 and provisional liners 45, 451, 452. Threaded provisional liners 45, 451, 452 are designed to provide a gathering of two different diameters of connected elements.

Mounting holes 46 of removable collets 44 are arranged depending on the elements of device to which unit 11 is connected, and diameter of fitment bore 47 corresponds to the diameter of this device. This solution is regardless of the presence or absence of additional downhole units.

Figure 4A:
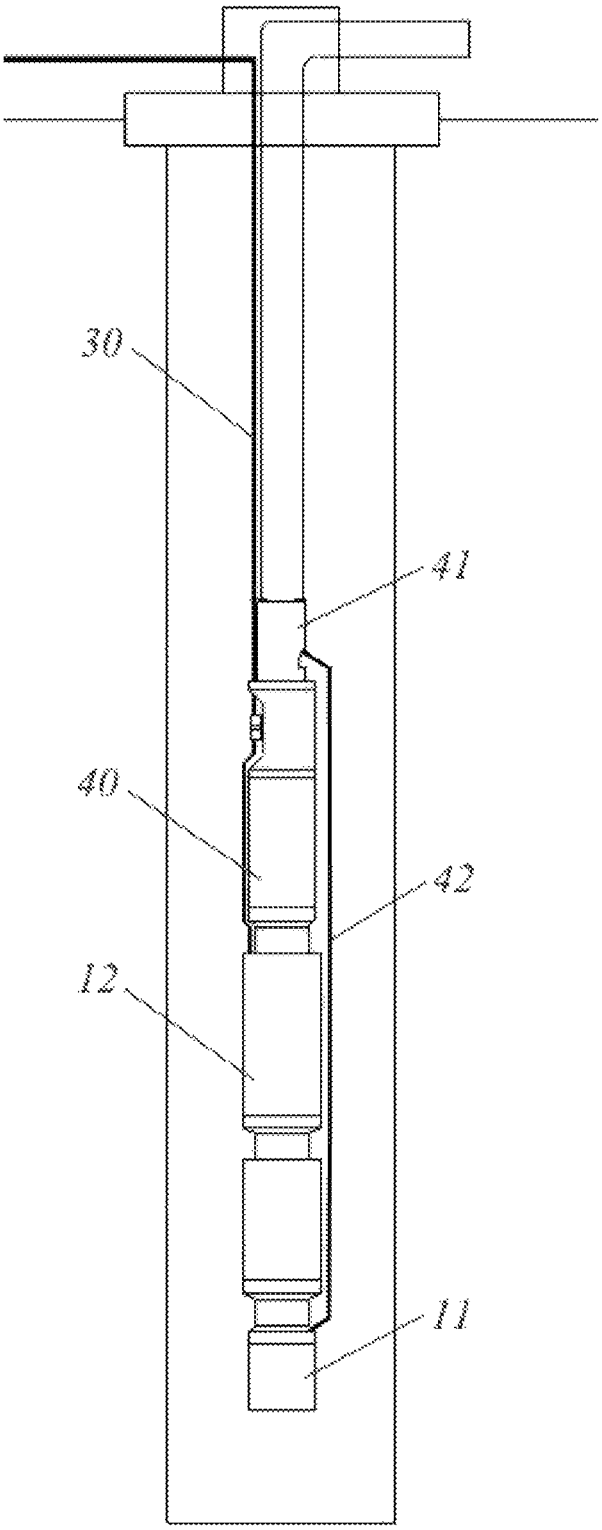
FIG. 4A illustrates an exemplary telemetry system with a downhole unit connected through an additional line with an additional downhole unit.
Figure 4B:
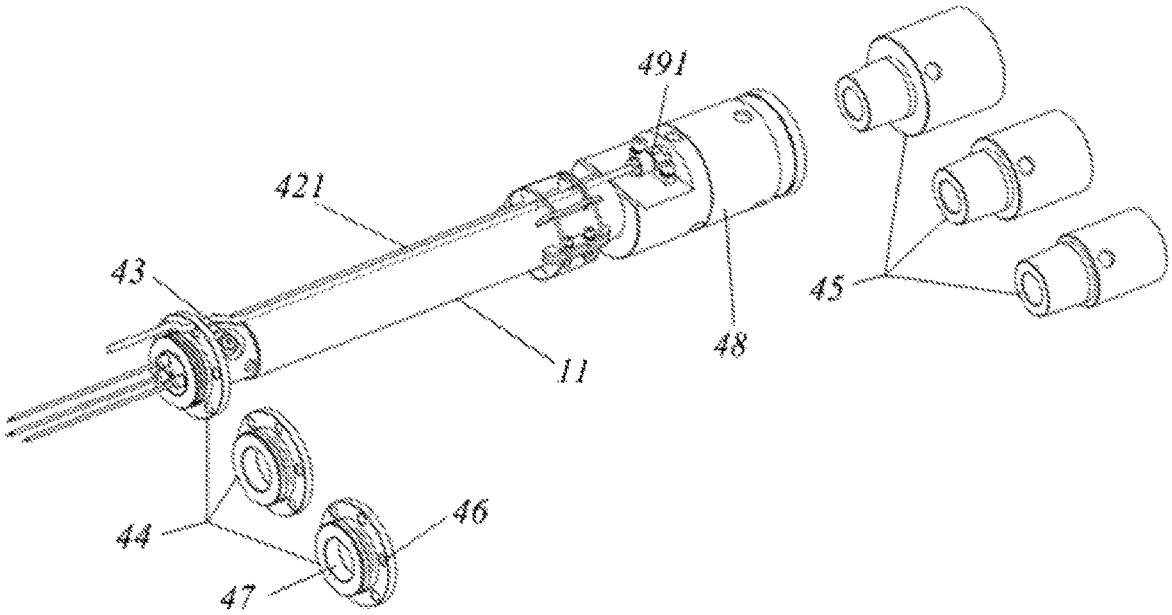
FIG. 4B illustrates an exemplary telemetry system where a downhole unit is presented with a set of replaceable threaded elements.
Figure 4C:
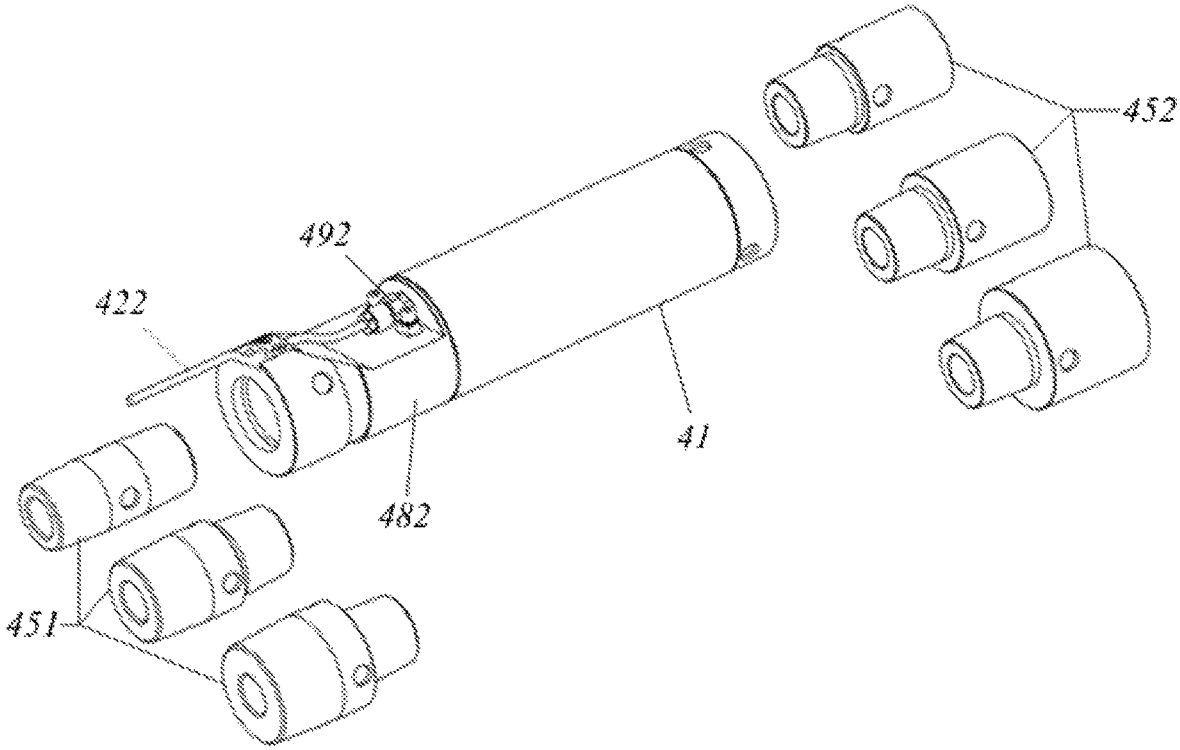
FIG. 4C illustrates an exemplary telemetry system where an additional downhole unit is presented with a set of replaceable threaded elements.
Figure 4D:
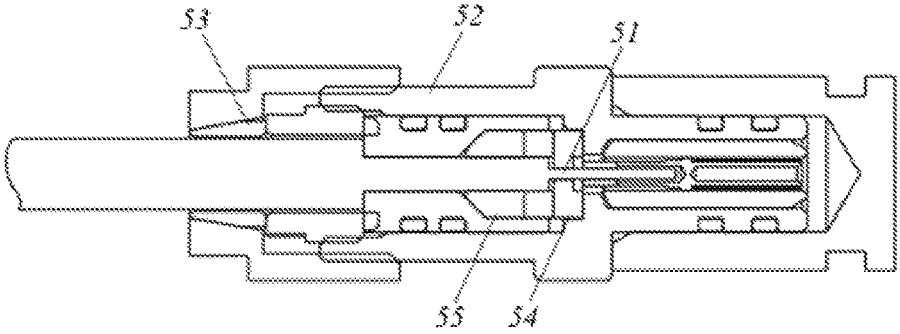
FIG. 4D illustrates an exemplary telemetry system where a section of a sealed cable connection of a downhole unit of a telemetry system is presented.

As shown in FIG. 4B, downhole unit 11 can be equipped with filling valve 43 for a motor.

The design allows unifying construction of the measurement system and ensures its use in submersible pumping devices with different dimensions of the body. Also, the described design allows replacement of the measurement units without disturbing their sealing. This fact provides maintenance of operation reliability and accuracy of measurements.

End adapter 482 of additional downhole unit 41 can be equipped with a plurality of sensors.

The connection of downhole units 11 and 41 which are presented in FIGS. 4 A-C is provided by additional line 42, which is cargo-carrying geophysical armored cable 421 (there is a cable location on the downhole unit 11), and 422 (there is a cable location on the additional unit 41).

Downhole unit 11 receives and collects signals from at least one additional downhole unit 41 through measurement and transmission device 24. The signals are transmitted to the input of surface unit 10.

Figure 5A:
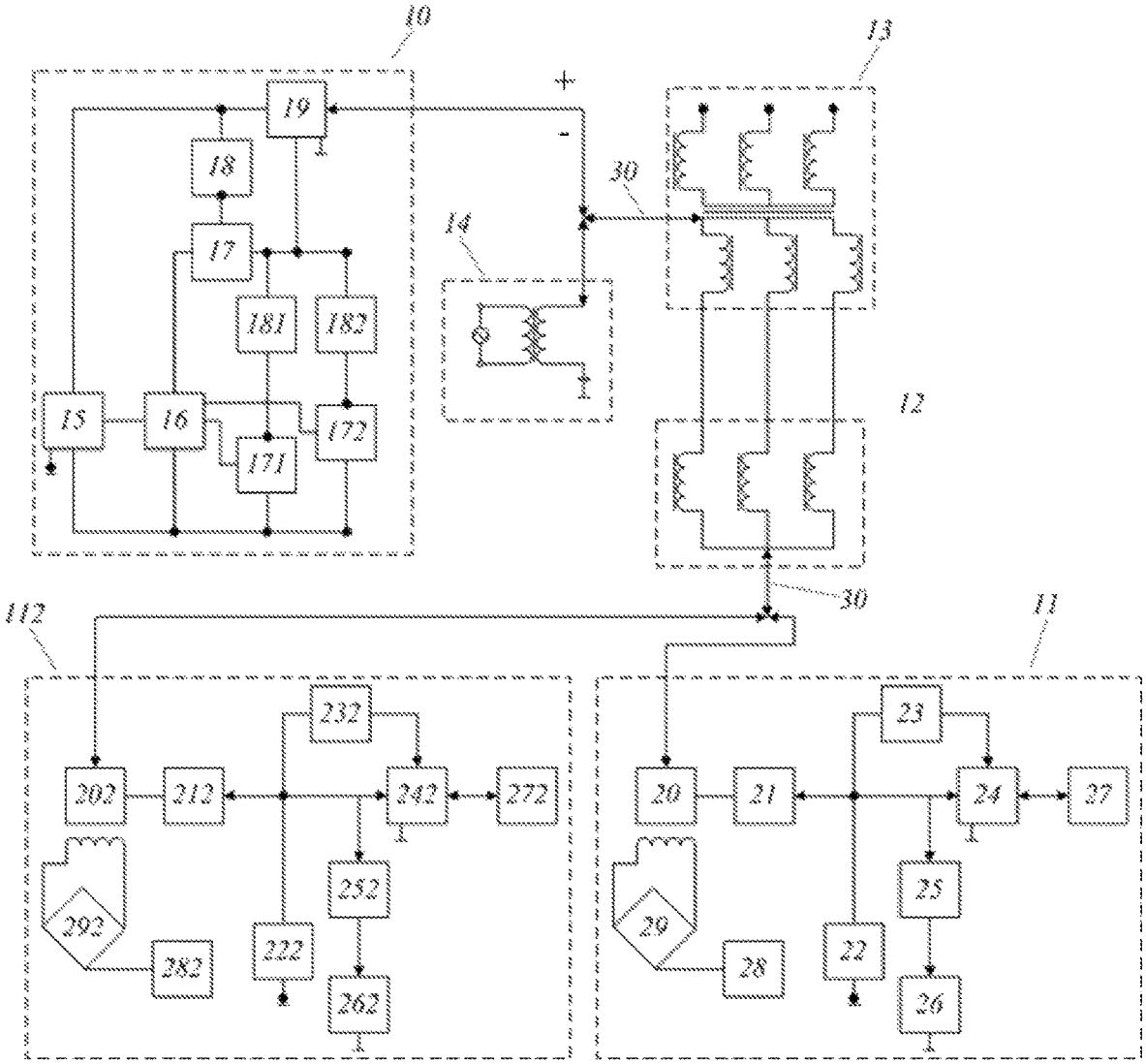
FIG. 5A illustrates an exemplary electrical circuit of a downhole unit of a telemetry system which includes two parts which duplicate each other's functions.
Figure 5B:
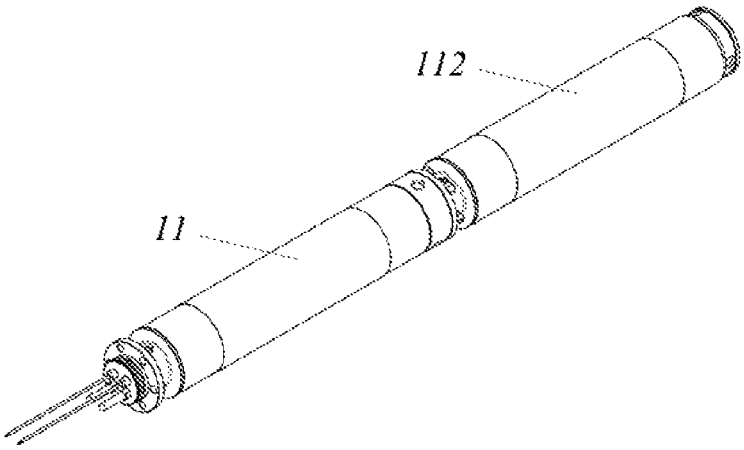
FIG. 5B illustrates an exemplary embodiment of a downhole unit of a telemetry system which includes two parts which duplicate each other's functions.

According to the following embodiment, as shown in FIGS. 5A, 5B, the telemetry system may include double downhole unit which duplicates its functions, both parts of which 11, 112 have identical design and do not communicate with each other. The housings of each part 11, 112 of the double downhole unit may be connected under condition of maintaining the sealing of each part 11, 112.

Surface unit 10 and the double downhole unit of the telemetry system communicate through transmission line of data and energy 30.

Surface unit 10 includes universal microprocessor controller 16 and direct voltage source 15 for powering each part 11, 112 of the double downhole unit. Alternating voltage from source 14 is supplied through independent phases.

Parts 11, 112 of the double downhole unit are connected in series to surface unit 10 and in parallel to each other. Each part 11, 112 of the double downhole unit includes measurement and transmission devices 24 and 242, respectively, with which voltage regulators 22 and 222 are connected in parallel and output signal generators 25 and 252 and data switches 26 and 262, respectively, are connected in series. Data switches 26 and 262 are controlled by measurement and transmission devices 24 and 242, respectively. Parts 11, 112 of the double downhole unit contain filtering and protection devices which include series-connected transformers 20, 202 and protection nodes 21 and 212, respectively.

Parts 11, 112 of double downhole unit include sensors 27 and 272 which perform the same functions. The cooling of the electronic components of the downhole unit is also carried according to the previously described method. Thermoelectric coolers 28 and 282 are connected with alternating voltage source 14 by independent phases of transformers 20 and 202, respectively, through rectifiers 29 and 292, respectively, radial motor 12 and neutral of step-up transformer 13.

Surface unit 10 of the telemetry system includes low-pass filter 19 which is installed low-pass filter on the input of surface unit 10. Low-pass filter 19 is configured to protect the device against overly high voltage. An analog-to-digital converter (not shown in FIGS.) is installed between universal microprocessor controller 16 and low-pass filter 19 of surface unit 10. The voltage is measured on transmission line of data and energy 30 by the analog-digital converter.

Surface unit 10 additionally includes additional switches 171, 172 and resistors 181, 182 connected through transmission line of data and energy 30 to parts 11, 112 of the double downhole unit.

Parts 11, 112 of the double downhole unit include voltage filters 23, 232, respectively. Voltage filters 23, 232 provide recognition of a useful signal under the influence of interference on line 30 for universal microprocessor controller 16 which is installed in surface unit 10.

Parts 11, 112 of the double downhole unit do not communicate with each other and they are installed in separate sealed enclosures. An example is presented in FIG. 5B.

To obtain measurement information, measurement data is received by surface unit 10 from parts 11, 112 of the double downhole unit. After that, the accuracy of the data is assessed and displayed by universal microprocessor controller 16.

In the measurement process, the state of connection of each part 11, 112 of the double downhole unit is determined by measuring the voltage on line 30 by an analog-digital converter. In case of exceeding the set value, which means the disconnection of one of the parts 11, 112 of the double downhole unit, switches 17, 171, 172 are switched on to resistors 18, 181, 182 which are installed in surface unit 10.

In case of proper operation of each part 11, 112 of the double downhole unit, switches 17, 171, 172 are switched off. After that, a command is transmitted from surface unit 10 to a first of two parts 11 or 112 of the double downhole unit, leaving a second part 11 or 112 on standby, and measurement data is being received from the first part. At the same time, the correctness of the data is being assessed. After that, the correct data is displayed in the surface unit 10 through universal microprocessor controller 16. In case of receiving incorrect data from the first part of the double downhole unit, identical operations are performed with a second part, leaving the first part on standby.

In case of receiving incorrect data from both parts 11, 112 of the double downhole unit, an algorithm to select correct values from data previously obtained from the double downhole unit is implemented by means of universal microprocessor controller 16 and the steps of obtaining data from parts 11, 112 of the double downhole unit reiterate.

The voltage values in line 30, which are measured by an analog-digital converter determine the need to apply resistors 18, 181, 182 in the event of failure of one of two parts 11, 112 of the double downhole unit. This allows one to provide the supply of suitable voltage (and limit the supply of excessive voltage) for a part which is running at the moment. These actions increase the reliability of the telemetry system.

Zero communication between parts 11, 112 of the double downhole unit leads to simplifying software algorithms. This fact increases the reliability of the telemetry system, and ensures sufficient reliability of the measurement results. The installation of each part 11, 112 of the double downhole unit in two sealed housings allows for the utilization of at least one of them in case of reducing the insulation resistance of other of them.

Applying any of the well-known algorithms for sampling the correct values from the previously received data, the telemetry system can remain operable in the event of a temporary failure of the double downhole unit.

Although the invention has been described in detail with reference to several embodiments, additional variations and modifications exist within the scope and spirit of the invention as described and defined in the following claims.

What is claimed:

1. A telemetry system comprising:

a surface unit;

a downhole unit in communication with the surface unit through a transmission line of data and energy;

an alternative voltage source in connection with the downhole unit for powering thermoelectric coolers through an independent phase;

wherein said surface unit comprising:

a direct voltage source in connection with the downhole unit for powering the downhole unit through the transmission line of data and energy;

a microprocessor controller in connection with the downhole unit through the transmission line of data and energy for controlling operation of the system and for collecting, processing and displaying measurement data;

a low-pass filter on an input of the surface unit to protect the telemetry system against overly high voltage;

a switch in connection with a voltage resistor configured to change a polarity of the voltage;

wherein said downhole unit comprising:

a measurement and transmission device in connection with a voltage regulator in parallel and with an output signal generator and a data switch in series, where the measurement and transmission device, the voltage regulator and the data switch are in connection with an earth enclosure;

a filtering and protection device that includes a protection node and a transformer with a primary winding of which includes low-pass filter configuration and a secondary winding sets an independent phase;

thermoelectric coolers in connection with the alternating voltage source through the independent phase and the transformer of the downhole unit, through a rectifier of the downhole unit, a radial motor and a neutral of a step-up transformer of the transmission line of data and energy;

electronic components grouped in several groups depending on the maximum temperature limits of their utilization, so that a spread of the average of maximum temperature limits of their operation in each group is minimal.

2. The telemetry system of claim 1, wherein said thermoelectric coolers are on a viscous heat-conducting composition the volume of which corresponds to the characteristics of thermal expansion of this composition which fills cooled components.

3. The telemetry system of claim 1 further comprising the downhole unit associated with a shaft or rotor bearing, and electronic components of which are located between pre-compressed inner and pre-stretched outer tubes in a radial direction and between at least two spacers in an axial direction.

4. The telemetry system of claim 3 further comprising a switching device of the downhole unit mounted on an inner radius of the filtering part of the transformer.

5. The telemetry system of claim 1 further comprising at least one additional downhole unit connected to the downhole unit through an additional transmission line of data and energy, and comprises any of the well-known telemetries or multiple sensors or one sensor which performs from the minimal value of electricity that can be transmitted from the surface unit through the downhole unit.

6. The telemetry system of claim 5, wherein said downhole unit and additional downhole unit include a set of interchangeable threaded elements mounted on end adapters sealed on the ends of the downhole unit and additional downhole unit.

7. The telemetry system of claim 6, wherein said downhole unit and additional downhole unit include sealed cable entries for installation of a conductive core and a set of deformable sealing elements configured with the possibility of radial and end sealing of the conductive core under the pressure of a fluid.

8. The telemetry system of claim 1, wherein the downhole unit includes removable collets mounting holes of which are arranged depending on the elements of a device to which the downhole unit is connected, and diameter of fitment bores corresponds to the diameter of this device.

9. The telemetry system of claim 1 further comprising an additional part of the downhole unit with the same design which duplicates functions of the downhole unit, assembles double downhole unit and does not communicate with the downhole unit.

10. The telemetry system of claim 1, wherein the surface unit is configured for the measurement of voltage on the transmission line of data and energy by an analog-to-digital converter installed between the microprocessor controller and the low-pass filter.

11. The telemetry system of claim 9, wherein the surface unit includes additional switches and resistors in connection through the transmission line of data and energy with the parts of the double downhole unit to maintain voltage control of the double downhole unit and to provide energy efficiency of the telemetry system.

12. A method for cooling downhole electronics in the telemetry system of claim 1, comprising the steps of:

mounting a variety of electronic components of the downhole unit in groups so that the spread of the maximum temperature limits of their operation in each group is minimal;

cooling a variety of electronic components of the downhole unit by the thermoelectric coolers;

selecting a performance of the thermoelectric coolers in accordance with the groups of electronic components in the downhole unit so that the group of electronic components with a higher average of their maximum temperature limits is cooled by the thermoelectric coolers which perform in total more heat transfer than the thermoelectric coolers which are cooling electronic components with a lower average of their maximum temperature limits; and powering the thermoelectric coolers from the alternating voltage source through the independent phase of the transformer of the downhole unit through the rectifier of the downhole unit, the radial motor and the neutral of the step-up transformer of the transmission line of data and energy.

* * * * *